United States Patent [19]

Spinner

[11] Patent Number: 4,944,701

[45] Date of Patent: Jul. 31, 1990

[54] COAXIAL PLUG-TYPE INNER CONDUCTOR CONNECTION

[76] Inventor: Georg Spinner, Am Eichberg 12, 8152 Feldkirchen-Westerham, Fed. Rep. of Germany

[21] Appl. No.: 319,655

[22] Filed: Mar. 6, 1989

[30] Foreign Application Priority Data

Mar. 15, 1988 [DE] Fed. Rep. of Germany ..... 3808632

[51] Int. Cl.[5] ..... H01R 13/17

[52] U.S. Cl. ..... 439/827; 439/825

[58] Field of Search ..... 439/816, 825, 826, 827, 439/843, 846, 847, 848, 851, 860, 883, 578–585, 675, 891

[56] References Cited

U.S. PATENT DOCUMENTS 4,082,411 4/1978 Storck ..... 439/827

FOREIGN PATENT DOCUMENTS 619108 4/1961 Canada ..... 439/825

577456 5/1933 Fed. Rep. of Germany ..... 439/825

2049739 4/1972 Fed. Rep. of Germany ..... 439/825

1058049 3/1954 France ..... 439/825

1409323 7/1965 France ..... 439/825

708468 5/1954 United Kingdom ..... 439/825

*Primary Examiner*—David L. Pirlot

*Attorney, Agent, or Firm*—Henry M. Feiereisen

[57] ABSTRACT

A plug-type inner conductor connection includes a rigid metallic socket and a plug which is insertable into the socket and includes a radially resilient forward portion of reduced outer diameter which ends at an annular shoulder defining a stop for the front end face of the socket. In order to attain accurate centering of the plug within the socket and an even contacting over the circumference, the forward portion of the plug is surrounded by a contact cap which has a base fixedly connected to the plug and a wall so shaped to impart a resiliency in radial direction and with an outer diameter which is at its greatest value at or in the area of the edge of the contact cap in vicinity of the annular shoulder.

15 Claims, 2 Drawing Sheets

COAXIAL PLUG-TYPE INNER CONDUCTOR CONNECTION

BACKGROUND OF THE INVENTION

The present invention refers to a coaxial plug-type inner conductor connection, and in particular to an inner conductor connection with a rigid metallic socket and a plug which is insertable into the socket and includes a radially resilient forward portion of reduced outer diameter which ends at an annular shoulder defining a stop for the front or leading end face of the socket.

The quality of a coaxial plug connection depends primarily on the construction of the plug-type inner conductor connection. The most common plug-type connection for the inner conductor combines the use of a resilient socket and a rigid plug. However, the combination of a rigid socket with a radially resilient plug is also known. Both constructions attempt a contact at the front end face or at least in the area near the front end face of the socket in order to prevent an undesired lengthening of the electric path.

German publication No. DE-GM 72 11 401 describes a coaxial plug-type inner conductor connection in which a rigid socket cooperates with a radially resilient plug of hollow cylindrical design and made of resilient bronze. The plug is axially slotted beyond the contact point and is bent up in barrel-shaped manner so that the outer diameter of the plug—after being inserted into the socket—is reduced to a value required for the wave impedance and simultaneously attains a contacting primarily in the area of the inner end face of the socket.

It is further known to provide a massive plug insertable into a rigid socket and including a groove or the like at its outer surface for receiving a spring contact ring.

Both these constructions have proven to be insufficient when high precision of the plug connection is demanded because the plug could not accurately be centered in the socket and the resiliency of the plug proved to be unsatisfactory.

SUMMARY OF THE INVENTION

It is thus an object of the present invention to provide an improved coaxial plug-type inner conductor connection obviating the afore-stated drawbacks.

This object and others which will become apparent hereinafter is attained in accordance with the present invention by surrounding the forward portion of the plug with a contact cap of resilient material and including a base connected to the opposing end face of the forward portion and a wall which is slotted in axial direction and increasingly expands radially in direction toward the annular shoulder.

Through the provision of such a contact cap surrounding the forward portion of the plug, the plug can be a simple turned member which can be manufactured with high accuracy and does not have to be made of resilient material For the contact cap, on the other hand, the best suited resilient material can be selected and the springiness or resiliency can be adapted in an optimum manner to the respective application. The plug connection shows superior mechanical stability and superior electric properties.

Suitably, the wall of the contact cap is so shaped that its greatest diameter is located at or near the edge facing the annular shoulder in order to keep the electric path as short as possible.

According to another feature of the present invention, the wall of the contact cap is axially slotted to provide spring plates which may be twisted by a small angle about their respective longitudinal axis. Instead of being twisted in this manner, the spring plates may also be arched transversely to their respective longitudinal axis. By shaping the spring plates in this manner, a notch effect is created resulting between the inner end face of the socket and the circumferential area of the plug lying within the same radial plane in a contact of very low impedance and even distribution about the circumference.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
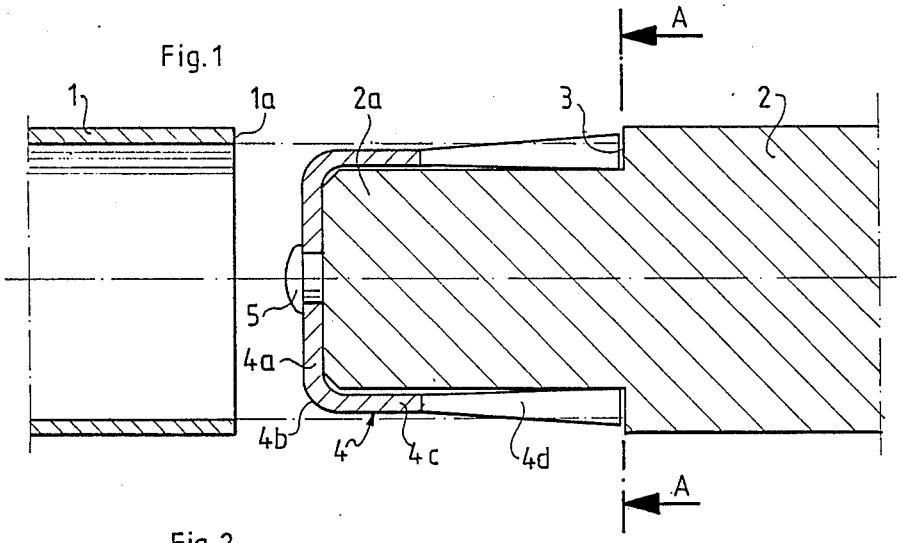
FIG. 1 is a schematically simplified longitudinal section of a first embodiment of a plug-type inner conductor connection in accordance with the present invention, with the inner conductor being in unplugged position.
Figure 2:
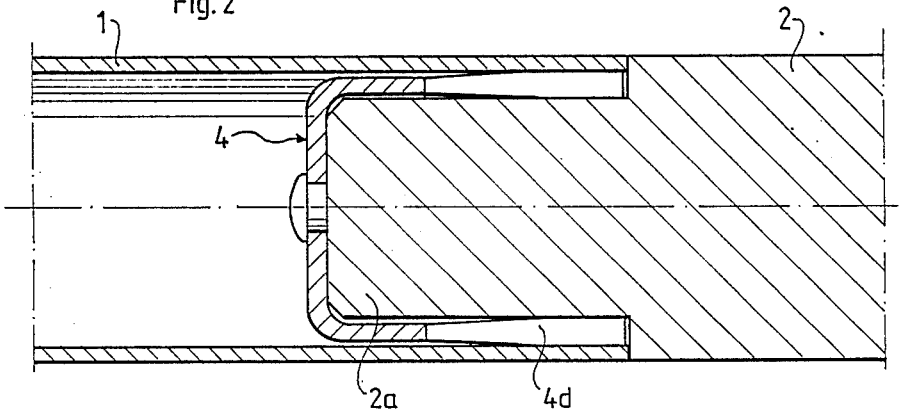
FIG. 2 is a longitudinal section of the plug-type inner conductor connection of FIG. 1, with the inner conductor being in plugged position.

Referring firstly to FIGS. 1 and 2, there is illustrated a plug-type inner conductor connection with a hollow cylindrical socket 1 and a solid cylindrical plug 2. The plug 2 has an outer diameter which corresponds to the outer diameter of the socket 1, and includes a forward portion 2*a* of reduced diameter by which the plug 2 is inserted into the socket 2 to attain the plugged connection. Defined at the junction of the plug 2 with the forward portion 2*a* is an annular shoulder or step 3 which provides a stop for the annular end face 1*a* of the socket 1 when the plug 2 is inserted into the socket 1.

Placed over the forward portion 2*a* of the plug 2 is a contact cap which is generally designated by reference numeral 4 and realizes a contact of the plug 2 with the socket 1. The contact cap 4 has a base 4*a* which is fixedly attached to the forward portion 2*a* of the plug 2 via a rivet 5 and is connected to a wall 4*c* extending toward the annular shoulder 3. In order to facilitate insertion of the plug 2 into the socket, the base 4*a* is provided with rounded edges 4*b* at the junction to the wall 4*c*.

Extending from its rearward edge facing the annular shoulder 3 of the plug 2, the wall 4*c* s provided with a plurality of axial slots along a major part of its length so as to define a plurality of spring plates or spring lamella 4*d* of radial resiliency.

Figure 3:
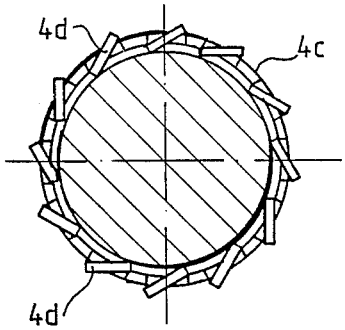
FIG. 3 is a cross sectional view of the inner conductor plug taken along the line A–A in FIG. 1 and illustrating the forward portion of the plug provided with a spring plate arrangement.

As shown in FIG. 3 which is a cross sectional view of the inner conductor plug taken along A–A in FIG. 1, the plates 4*d* are twisted about their respective longitudinal axis by a small angle. The degree of twist is dependent on the width of the plates 4*d* and is selected in such a manner that the contact cap 4 in unplugged state has an outer diameter which increases in direction toward the annular shoulder 3 of the socket 2. As illustrated in FIG. 1, the increase of the outer diameter of the contact cap 4 is such that its greatest value is at or in the area of the rearward edge of the contact cap 4 opposing the annular shoulder 3 and clearly exceeds the inner diameter of the socket 1. Suitably, the contact cap 4 is made of resilient material such as e.g. bronze so that by inserting the plug 2 into the socket 1 as shown in FIG. 2, the plates 4*d* intimately bear against the inside surface of the socket 1 so as to attain an inner conductor connection of plug 2 and socket 1 at very low contact resistance which is also evenly distributed over the circumference of the plug-type connection.

Figure 4:
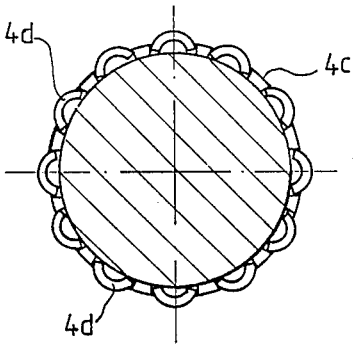
FIG. 4 is a cross sectional view of the inner conductor similar to FIG. 3 and illustrating a modified spring plate arrangement.

Instead of being twisted as shown in FIG. 3, the plates 4*d* may also be provided in semicircular shape—as illustrated in FIG. 4—by bending or arching the plates 4*d* transverse to the longitudinal axis thereof so that each spring plate 4*d* defines a longitudinal fold which extends parallel to the plug axis.

Advantageously, the contact cap 4 may be manufactured by shaping a respective sheet metal blank in non-cutting manner e.g. by deep-drawing. The plates 4*d* are then provided by suitably slotting the sheet metal and twisting or arching the same in order to accomplish either of the configurations as shown in FIGS. 3 and 4.

Figure 5:
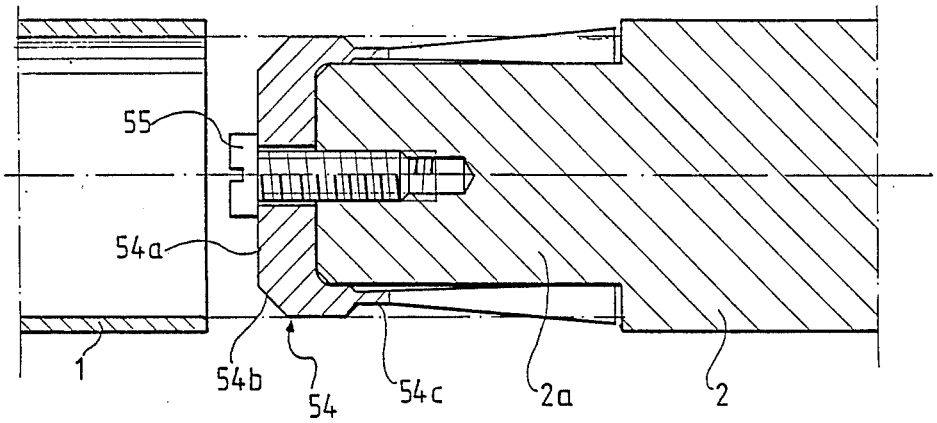
FIG. 5 is a schematically simplified longitudinal section of a second embodiment of a plug-type inner conductor connection in accordance with the present invention, with the inner conductor being in unplugged position.

The contact cap 4 may, however, also be a turned member as shown e.g. in FIG. 5 which illustrates a longitudinal section of a second embodiment of a plug-type inner conductor connection in accordance with the invention, with the forward section 2*a* of the plug 2 being enclosed by contact cap 54. The base 54*a* of the contact cap 54 is connected to the forward section 2*a* by a bolt 55. At the junction of the base 54*a* with the wall 54*c*, the contact cap 54 is provided with a bevelled edge 54*b* to facilitate insertion of the plug 2 into the socket 1 and to ensure centered positioning thereof within the socket 1.

Figure 6:
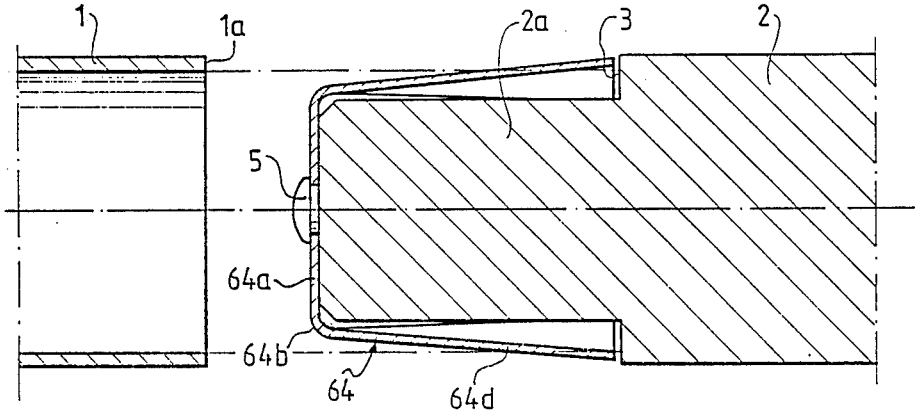
FIG. 6 is a schematically simplified longitudinal section of a third embodiment of a plug-type inner conductor connection in accordance with the present invention, with the inner conductor being in unplugged position.
Figure 7:
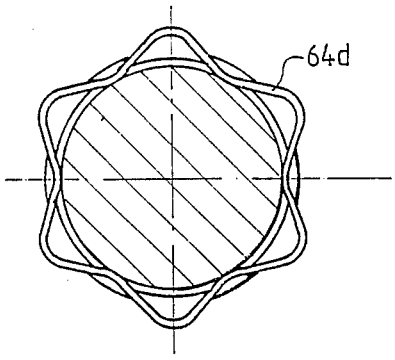
FIG. 7 is a cross sectional view of the inner conductor plug as illustrated in FIG. 6.

Turning now to FIGS. 6 and 7, there is shown a third embodiment of a plug-type inner conductor connection in accordance with the present invention which differs from the previously described embodiments only by the design of the contact cap. Accordingly, a contact cap generally designated by reference numeral 64 includes a base 64*a* which is connected to the forward portion 2*a* of the plug 2 by a rivet 5 and includes a rounded edge 64*b* for facilitating insertion thereof into the socket 1. In contrast to the previously described embodiments, the contact cap 64 is provided with a non-slotted wall 64*d* which—as shown in FIG. 7 attains its radial resiliency through corrugation about its circumference so as to be of star-like shape in a cross sectional view. FIG. 6 shows that the crown height of the corrugation as viewed from the rounded edge 64*b* extends parallel to the plug axis and increases steadily in direction toward the annular shoulder 3 so that the contact cap 64 has at its rearward edge opposing the annular shoulder 3 its greatest outer diameter which considerably exceeds the inner diameter of the socket 1 before inserting the plug 2 into the socket 1.

While the invention has been illustrated and described as embodied in a coaxial plug-type inner conductor connection, it is not intended to be limited to the details shown since various modifications and structural changes may be made without departing in any way from the spirit of the present invention.

What is claimed as new and desired to be protected by Letters Patent is set forth in the appended claims:

I claim:

1. A coaxial plug-type inner conductor connection, comprising:

a socket having an inner diameter and defining an end face;

a plug defining a plug axis and having a forward portion of reduced diameter so as to define an annular shoulder providing a stop for said end face of said socket; and a contact cap surrounding said forward portion of said plug, said contact cap having a base attached to said forward portion at an end face opposing said contact cap and a wall suitably shaped so as to impart a radial resiliency thereto, said wall having at its distal end from said base a greatest outer diameter which exceeds said inner diameter of said socket and being provided with a plurality of axial slots so as to be subdivided into resilient spring plates, with each individual spring plate being arched transverse to its longitudinal axis so as to define a longitudinal fold which extends parallel to said plug axis.

2. A coaxial connection as defined in claim 1 wherein said wall of said contact cap is provided with slots in axial direction extending from said distal end toward said base.

3. A coaxial connection as defined in claim 1 wherein said plug and its forward portion are constituted by a solid cylinder.

4. A coaxial connection as defined in claim 1, and further comprising a rivet for attaching said base of said contact cap to said end face of said forward portion of said plug.

5. A coaxial connection as defined in claim 1, and further comprising a bolt for attaching said base of said contact cap to said end face of said forward portion of said plug.

6. A coaxial connection as defined in claim 1 wherein said contact cap is provided with a circumferential rounded edge at the junction of said base with said wall for facilitating insertion of said plug into said socket.

7. A coaxial connection as defined in claim 1 wherein said contact cap is provided with a circumferential bevelled edge at the junction of said base with said wall for facilitating insertion of said plug into said socket.

8. A coaxial connection as defined in claim 1 wherein said socket is rigid and made of metal.

9. A coaxial connection as defined in claim 1 wherein said contact cap is made of resilient sheet metal through shaping in non-cutting manner.

10. A coaxial connection as defined in claim 9 wherein said contact cap is made by means of deep-drawing.

11. A coaxial plug-type inner conductor connector, comprising:

a plug defining a plug axis and being adapted for connection with a socket; and a contact cap placed on said plug and provided with a plurality of axial slots to thereby form resilient spring plates, with each individual spring plate being arched transverse to its longitudinal axis so as to define a longitudinal fold which extends parallel to said plug axis.

12. A coaxial plug-type inner conductor connection, comprising:

a socket having an inner diameter and defining an end face;

a plug defining a plug axis and having a forward portion of reduced diameter so as to define an annular shoulder providing a stop for said end face of said socket; and a contact cap surrounding said forward portion of said plug, said contact cap having a base attached to said forward portion at an end face opposing said contact cap and a wall suitably shaped so as to impart a radial resiliency thereto, said wall having at its distal end from said base a greatest outer diameter which exceeds said inner diameter of said socket and being provided about its circumference with corrugations, with each individual corrugation crown extending parallel to said plug axis.

13. A coaxial connection as defined in claim 12 wherein said crown height of said corrugations increases steadily in the direction toward said annular shoulder.

14. A coaxial plug-type inner conductor connection, comprising:

a plug defining a plug axis and being adapted for connection in a socket; and a contact cap placed on said plug and being provided about its circumference with corrugations, with each individual corrugation crown extending parallel to said plug axis.

15. A coaxial connection as defined in claim 14 wherein said crown height of said corrugations increases steadily in the direction of said longitudinal axis.

* * * * *